US005694857A

United States Patent [19]

Taylor

[11] Patent Number: 5,694,857

[45] Date of Patent: Dec. 9, 1997

[54] TRUSS FOR OVERHEAD BRIDGE CRANE

[75] Inventor: Michael K. Taylor, Farmington, N.Y.

[73] Assignee: Gorbel, Inc., Fishers, N.Y.

[21] Appl. No.: 681,157

[22] Filed: Jul. 22, 1996

[51] Int. Cl.[6] ..... B61D 49/00

[52] U.S. Cl. ..... 104/137; 105/163.1; 212/312

[58] Field of Search ..... 104/89, 91, 124, 104/137; 105/163.1; 312/312, 313–327; 52/690, 694

[56] References Cited

U.S. PATENT DOCUMENTS

| | | | |
|---|---|---|---|
| 1,296,755 | 3/1919 | Buckley | 105/163.1 |
| 1,296,757 | 3/1919 | Buckley | 105/163.1 |
| 1,383,065 | 6/1921 | Biggert | 212/323 |
| 1,791,680 | 2/1931 | Miller | 52/690 |
| 1,873,076 | 8/1932 | Ackeren | 212/312 |
| 3,247,634 | 4/1966 | Attwood . | |
| 5,335,468 | 8/1994 | Oberman et al. | 52/690 |

OTHER PUBLICATIONS

Excerpt from *The Engineers' Illustrated Thesaurus* by Herbert Herkimer, Wm. Penn Publishing Corp., New York, NY, 1952 (Chemical Publishing Co., Inc., NY), pp. 94–95.

P. 39 from "Ceiling Mounted Bridge Cranes & Monorails" catalog of assignee showing typical prior art trusses used in overhead cranes, Gorbel, Inc., 1995.

*Primary Examiner*—Mark T. Le

*Attorney, Agent, or Firm*—Eugene Stephens & Associates

[57] ABSTRACT

An overhead bridge crane truss having a channel connected to a support beam by vertical connectors is improved in strength by adding wide braces at end regions of the truss, without significantly increasing truss weight or cost. The wide braces are rectangular box beams welded around their upper and lower peripheries respectively to the bottom of the support beam and the top of the channel.

12 Claims, 1 Drawing Sheet

10
11
12
13
14
15
20
25
26
27
28
1/4

TRUSS FOR OVERHEAD BRIDGE CRANE

TECHNICAL FIELD

Bridge crane trusses.

BACKGROUND

Light weight, strength, and economy are all important for bridge crane trusses. Reasons for this include the fact that the bridges extending between the parallel runs of bridge cranes are moved manually, along with their loads. Minimizing the mass of the bridge of the crane is important for minimizing the muscular effort required by a worker moving a load with the crane. Economy of manufacture is also important so that light weight and strength can be offered at an attractively low price. Strength is a virtue, providing light weight and economy are preserved, so that overhead cranes that minimize weight and cost can maximize their load-handling ability.

These requirements impose strict criteria on the design of steel trusses for overhead bridge cranes. The solution that has evolved to meet these criteria is a Vierendeel truss such as shown in FIG. 1. In attempting to maximize strength while minimizing weight and expense of such a truss, I have found an inexpensive way of significantly increasing truss strength, without significantly increasing expense or weight. This affords a worthwhile advance in the otherwise established crane truss art.

SUMMARY OF THE INVENTION

My improvement of a steel Vierendeel truss for bridge cranes involves braces welded into end regions of the truss, while leaving the usual vertical connectors joining a bottom channel to a support beam along a central length of the truss. The end region braces are generally rectangular box beams that interconnect the channel and the support beam. The box beam braces have a longitudinal width at least 2.5 times the longitudinal width of the vertical connectors spaced along a central region. The generally rectangular peripheries of the ends of the box beam braces are welded respectively to the support beam and to the channel. The support beam is preferably square in cross section, as are the vertical connectors. These are preferably the same size so that the longitudinal width of the end region braces is also at least 2.5 times a transverse width of the support beam. The box beam end braces need not be as wide in a transverse direction, however; and in this direction, they can be narrower than the vertical connectors or the support beam.

DRAWINGS

DETAILED DESCRIPTION

Figures 1, 2, 3, 4:
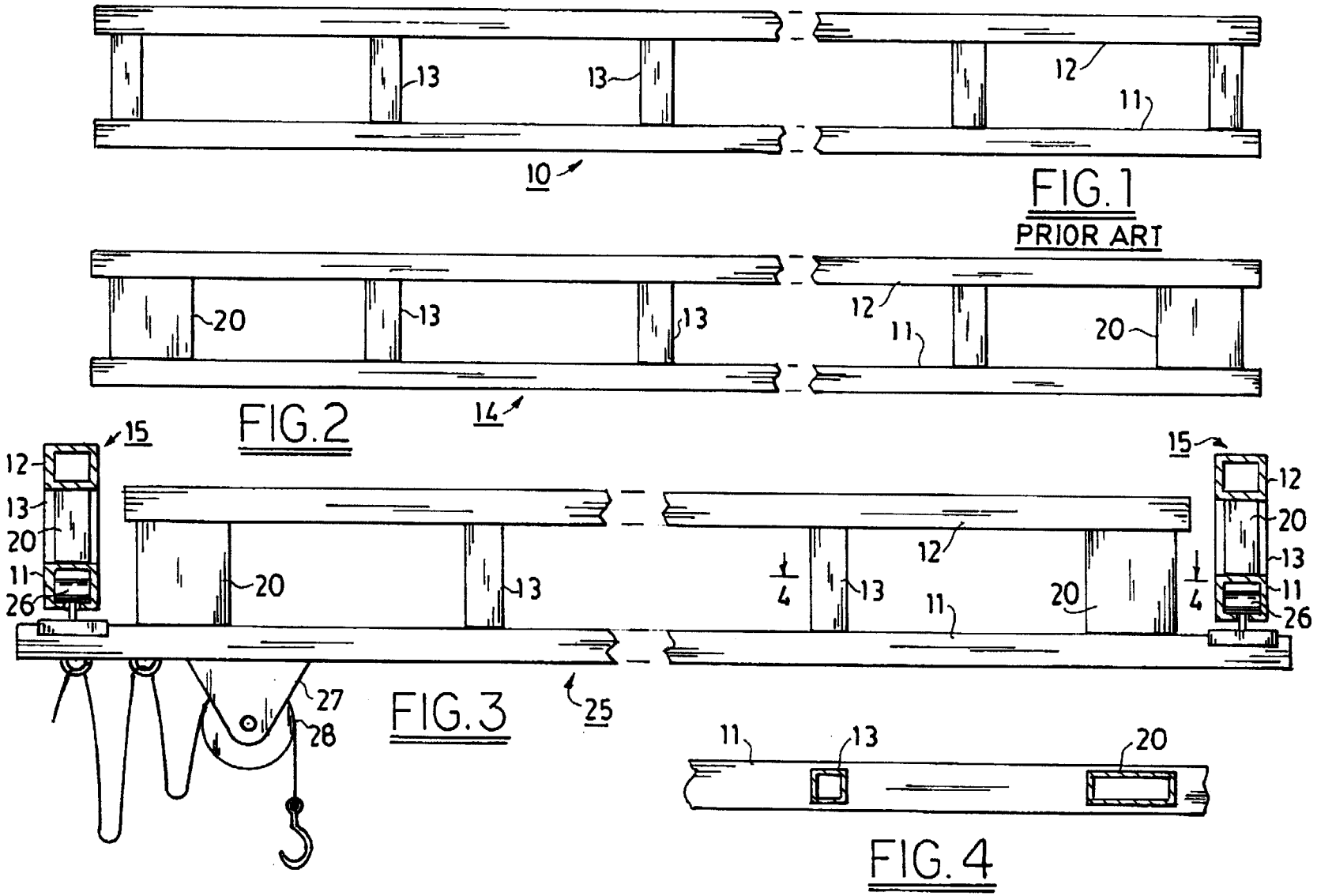
FIG. 1 PRIOR ART
FIG. 1 is a partially schematic, elevational view of a prior art crane truss usable as a run in an overhead bridge crane.
FIG. 2 is a partially schematic, elevational view similar to the view of FIG. 1 and showing the inventive form of crane truss.
FIG. 3 is a partially schematic, elevational view of the inventive truss deployed as a bridge between a pair of overhead bridge crane runs also using the inventive truss.
FIG. 4 is a fragmentary cross-sectional view of the bridge of FIG. 3, taken along the line 4—4 thereof.

The Vierendeel truss shown in FIG. 1 has become well established in the overhead bridge crane art, where it is used for both runs and bridges. Illustrated in FIG. 1 is a typical configuration of a run truss 10 having a channel 11 and a support beam 12 interconnected by vertical box beams 13. Connectors 13 are periodically spaced along the length of truss 10; and channel 11, connectors 13, and support beam 12 are all welded together. Channel 11 supports end trucks of a crane bridge that can move along the length of a pair of parallel runs 15. These are supported in various ways to uphold a load comprising the bridge and an object lifted by the bridge.

My improvement of a Vierendeel truss 14, as shown in FIG. 2, uses the same channel 11, support beam 12, and vertical connectors 13, but substitutes box beam braces 20 in place of vertical connectors 13 at end regions of the truss. Braces 20 are at least 2.5 times as wide as vertical connectors 13 in the longitudinal direction of truss 14. Braces 20 are generally rectangular in cross-sectional shape, instead of having the generally square cross-sectional shape of connectors 13. The substitution of wide braces 20 for narrow connectors 13 at end regions of the truss stiffens and strengthens the truss without significantly adding to its weight or expense so that the truss serves more satisfactorily when deployed in a bridge crane.

Trusses formed of elements having smaller dimensions and made with end braces 20 can be as strong as previous trusses having larger dimensions. In other words, trusses of approximately the same weight and expense can provide more strength when made with end braces 20, or strength can be held constant while end braces 20 allow crane trusses to be reduced in weight and expense.

The inventive truss with end region braces 20 is especially desirable for deployment as a bridge 25 that is movable between a pair of parallel runs 15, as shown in FIG. 3. The combination of increased strength with low weight and cost pays an extra dividend in bridge 25 which is manually moved between runs 15, along with whatever load is suspended from bridge 25. Lighter weight for the strength offered in bridge 25 reduces the mass that a worker has to move when moving a load lifted by the bridge.

FIG. 3 also illustrates schematically some of the elements that allow bridge 25 to work as a component of an overhead bridge crane. These include end trucks 26 running in channels 11 of each of the runs 15, which are also preferably made with end region braces 20. End trucks 26 are clamped to end regions of channel 11 of bridge truss 25. The channel extends longitudinally beyond braces 20 at end regions of the truss. This allows a trolley 27, which runs in channel 11, and a hoist 28, carried by trolley 27, to move laterally for at least the full distance between runs 15. It also disposes the truss portion of bridge 25 in between runs 15 where its vertical height does not reduce the lifting height offered by hoist 28.

Channels 11 have bottom opening slots that accommodate the movement of end trucks 26 along runs 15 and the movement of trolley 27 along bridge 25. Support beams 12 are preferably generally square in cross section as shown for runs 15 in FIG. 3. Vertical connectors 13 are preferably formed of the same steel as support beams 12 so that they also have generally square cross sections, as shown in FIG. 4. The square peripheries at each end of connectors 13 are welded respectively to the bottoms of support beams 12 and the tops of channels 11.

Although braces 20 can have the same transverse width as connectors 13 and support beam 12, I have found that braces 20 can be transversely narrower than elements 12 and 13, as shown in FIGS. 3 and 4, without loss of strength and effectiveness. The generally rectangular end peripheries of braces 20 are also welded respectively to the bottom of support beam 12 and the top of channel 11.

Braces 20 add very little to the expense of trusses 15 and 25. The box beam material used for braces 20 is readily available at a low price, and the extra length of the weldments required around the upper and lower peripheries of end braces 20 adds only a minor additional expense. Compared with other truss variations such as adding diagonals or corner-strengthening gussets, end braces 20 are inexpensive, light in weight, and comparably effective.

I claim:

1. In combination with an overhead bridge crane, a steel truss having a horizontal bottom channel with a bottom opening slot so that a wheeled element can move along the channel to support a dependent load and having a support beam disposed above and parallel with the channel and interconnected with the channel by vertically oriented connectors, the combination comprising:

a. end regions of the truss having generally rectangular box beam braces interconnecting the channel and the support beam;

b. the generally rectangular box beam braces having a width, in a longitudinal direction of the truss, at least 2.5 times a width of the support beam, in a transverse direction of the truss;

c. generally rectangular peripheries of the ends of the box beam braces being welded respectively to the support beam and to the channel;

d. a central length of the truss between the end region braces having a plurality of the vertically oriented connectors formed as box beams spaced periodically along the central length and having peripheral ends welded respectively to the support beam and the channel; and e. said width of the braces being at least 2.5 times a width of the vertical connectors, in said longitudinal direction.

2. The combination of claim 1 wherein the support beam and the vertical connectors have generally square cross sections of equal size.

3. The combination of claim 1 wherein the end braces have a width, in said transverse direction, narrower than the width of the support beam, in said transverse direction.

4. The combination of claim 1 wherein the truss is deployed as a bridge of the crane, and the bottom channel extends beyond the end region braces of the truss and supports a trolley for a hoist of the crane.

5. The combination of claim 1 wherein the bottom channel of the truss supports end trucks for travelling on a pair of parallel runs.

6. The combination of claim 5 wherein the truss is deployed as a bridge of the crane, and the bottom channel extends beyond the end region braces of the truss and supports a trolley for a hoist of the crane.

7. In combination, an overhead bridge crane and a steel truss comprising:

a. end regions of the truss at opposite ends of a center length of the truss having end braces extending vertically between a channel having a bottom opening slot and a support beam parallel with the channel and spaced above the channel;

b. the end braces being box beams having a generally rectangular cross section;

c. the end braces having a rectangular periphery of an upper end welded to a bottom of the support beam and a rectangular periphery of a lower end welded to a top of the channel;

d. the end braces having a width, in a longitudinal direction of the truss, at least 2.5 times a width of the support beam, in a transverse direction of the truss;

e. the center length of the truss between the end braces having a plurality of periodically spaced and vertically oriented connectors formed as box beams welded to the bottom of the support beam and to the top of the channel; and f. said width of the end braces being at least 2.5 times a width of the vertical connectors, in said longitudinal direction of the truss.

8. The combination of claim 7 wherein the end braces have a width, in said transverse direction of the truss, narrower than a width of the vertical connectors, in said transverse direction of the truss.

9. The combination of claim 7 wherein the truss comprises a bridge of the crane, the channel supports a trolley for a crane hoist, and the channel extends longitudinally beyond the end braces.

10. The combination of claim 7 wherein the truss comprises a run of the crane, and the channel supports an end truck of a bridge of the crane.

11. The combination of claim 10 wherein the truss comprises a bridge of the crane, the channel supports a trolley for a crane hoist, and the channel extends longitudinally beyond the end braces.

12. The combination of claim 7 wherein the vertical connectors and the support beam are generally square in cross section and are generally equal in cross-sectional size.

* * * * *